US010220426B2

(12) United States Patent
Lim

(10) Patent No.: US 10,220,426 B2
(45) Date of Patent: Mar. 5, 2019

(54) DEVICE AND METHOD FOR GENERATING CHANNEL LETTERS

(71) Applicants: Seoul Laser Dieboard System Co., Ltd., San Diego, CA (US); Seoul Laser Dieboard System Co., Ltd., Kwong-gi-Do (KR)

(72) Inventor: Kyong-Chan Lim, San Diego, CA (US)

(73) Assignees: SEOUL LASER DIEBOARD SYSTEM CO., LTD, Kyunggido (KR); SEOUL LASER DIEBOARD SYSTEM CO., LTD LLP, San Diego, CA (US)

( * ) Notice: Subject to any disclaimer, the term of this patent is extended or adjusted under 35 U.S.C. 154(b) by 0 days.

(21) Appl. No.: 14/692,591

(22) Filed: Apr. 21, 2015

(65) Prior Publication Data

US 2015/0224555 A1 Aug. 13, 2015

Related U.S. Application Data

(63) Continuation-in-part of application No. 13/458,883, filed on Apr. 27, 2012, now Pat. No. 9,126,252,
(Continued)

(51) Int. Cl.
*G09F 7/16* (2006.01)
*B21D 11/08* (2006.01)

(52) U.S. Cl.
CPC ..... *B21D 11/08* (2013.01); *G09F 7/16* (2013.01); *Y10T 29/49906* (2015.01)

(58) Field of Classification Search
CPC ..... B21D 28/10; B21D 28/26; B21D 28/265; B21D 35/001; B21D 39/02; B21D 51/06;
(Continued)

(56) References Cited

U.S. PATENT DOCUMENTS 1,836,354 A * 12/1931 Abrams ..... B21D 53/74 160/405
2,006,925 A * 7/1935 Klemp ..... B21D 53/74 150/126

(Continued)

FOREIGN PATENT DOCUMENTS

JP 07-251387 10/1995
JP 8-30050 A 11/1996

(Continued)

OTHER PUBLICATIONS

International Search Report and Written Opinion dated Jun. 24, 2009 from International Patent Application No. PCT/US2008/082371, in 10 pages.

(Continued)

*Primary Examiner* — Jason L Vaughan
(74) *Attorney, Agent, or Firm* — Procopio, Cory, Hargreaves & Savitch LLP

(57) ABSTRACT

The disclosure provides a method and apparatus for forming a channel letter box using a profile. The method can include determining an incision position on one surface of the profile where at least one surface incision is to be made. The profile can be surface incised at the determined position. The profile can be folded at the incision position to form the channel letter box. The profile can have at least one rib on one surface. The method can also include cutting and attaching a top plate to the channel letter box, wherein a thickness of the top plate is substantially close to a distance from the top of the profile to the top of a top rib of the at least one rib.

12 Claims, 23 Drawing Sheets

Related U.S. Application Data which is a continuation-in-part of application No. 13/133,133, filed on Jan. 10, 2012.

(58) Field of Classification Search

CPC ..... B21D 51/52; B21D 53/74; G09F 7/00; G09F 7/16; G09F 7/165; G09F 2013/1881; G09F 13/0404; G09F 13/0413; G09F 2013/0418; G09F 2013/0445; G09F 2013/0481; G09F 13/08; G09F 13/10; Y10T 29/49906; B32B 37/1284; B32B 37/1292; B32B 37/18

See application file for complete search history.

(56) References Cited

U.S. PATENT DOCUMENTS 3,396,483 A * 8/1968 Stein ..... G09F 13/0413 40/549
3,610,189 A * 10/1971 Doebling ..... B29C 67/00 72/324
3,690,079 A * 9/1972 Hemminger ..... E04B 2/965 428/573
3,713,578 A * 1/1973 Johnson ..... B65D 5/6697 16/225
3,788,934 A * 1/1974 Coppa ..... A63H 33/16 428/12
3,848,324 A * 11/1974 Perger ..... B21D 49/00 228/170
4,114,065 A * 9/1978 Horvay ..... F25D 21/04 220/592.1
4,402,170 A * 9/1983 Seidner ..... E06B 1/32 52/631
4,517,251 A * 5/1985 Mosely ..... A47G 33/08 40/539
4,628,661 A * 12/1986 St. Louis ..... E04C 2/40 52/105
5,018,263 A * 5/1991 Stern ..... B21D 35/00 160/371
5,245,852 A * 9/1993 Pullum ..... B21D 5/04 72/211
5,316,165 A * 5/1994 Moran, Jr. ..... H02G 3/10 220/3.2
5,456,099 A * 10/1995 Lipari ..... B21D 5/004 72/12.1
5,799,557 A 9/1998 Wang
5,881,525 A * 3/1999 Riegelman ..... E06B 9/52 160/377
6,123,435 A * 9/2000 Wang ..... F21V 15/01 362/147
6,446,399 B1 * 9/2002 Lecours ..... E04B 9/0414 52/273
6,484,980 B2 * 11/2002 Medlin, Sr. ..... H02G 3/125 220/3.5
6,640,605 B2 * 11/2003 Gitlin ..... B21D 5/00 72/379.2
6,877,349 B2 * 4/2005 Durney ..... B21D 28/10 428/136
7,534,501 B2 * 5/2009 Durney ..... E04B 2/78 428/122
7,546,793 B2 * 6/2009 Lasusa ..... B23P 15/00 83/522.19
8,186,340 B2 * 5/2012 Soucy ..... F24J 2/10 126/627
8,484,912 B2 * 7/2013 Engelmeyer ..... E06B 3/66314 52/204.591
8,770,182 B2 * 7/2014 Christopoulos ..... A47J 37/041 126/1 R
8,777,825 B1 * 7/2014 Kling ..... B31B 1/00 493/162
2004/0031177 A1 * 2/2004 Gordon ..... G09F 7/16 40/551
2005/0005746 A1 * 1/2005 Linenberger ..... B21D 11/08 83/39

FOREIGN PATENT DOCUMENTS

JP 2002-178040 A 6/2002
KR 1002333350000 12/1999
KR 1003888890000 6/2003
KR 10-2003-0043131 6/2004

OTHER PUBLICATIONS

Extended European Search Report for EP 08847169.3, issued by the European Patent Office, mailed on 16 Mar. 2015.

* cited by examiner

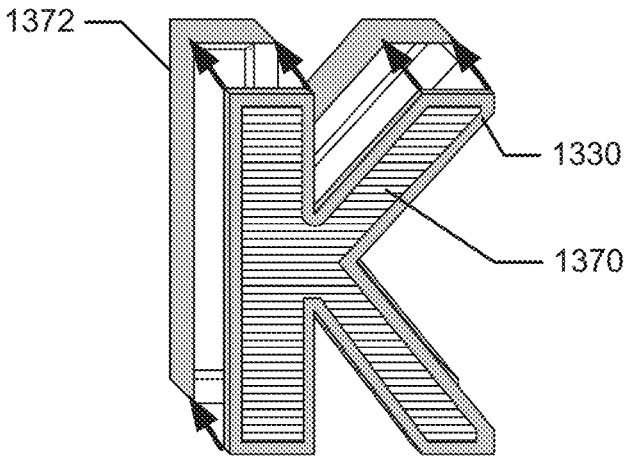
FIG. 13E
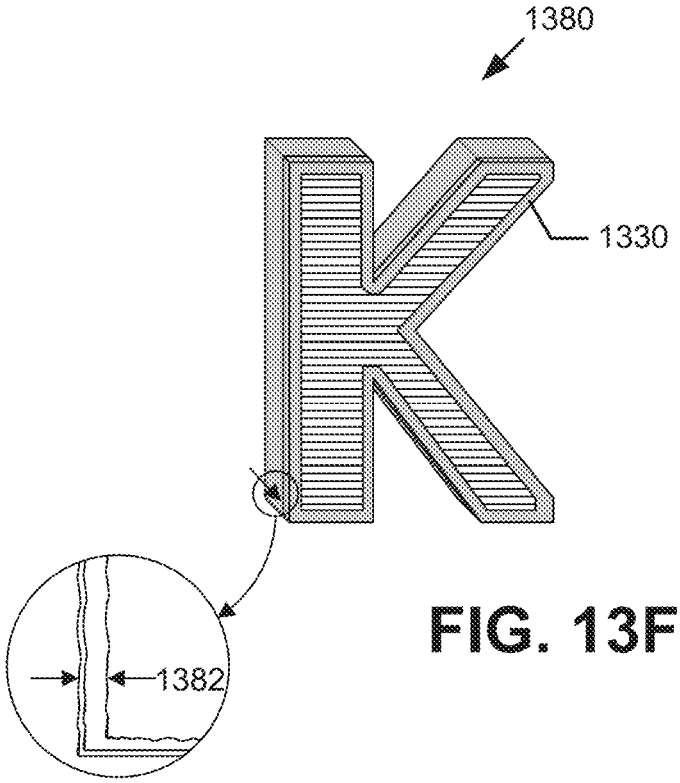
FIG. 13F
FIG. 13G

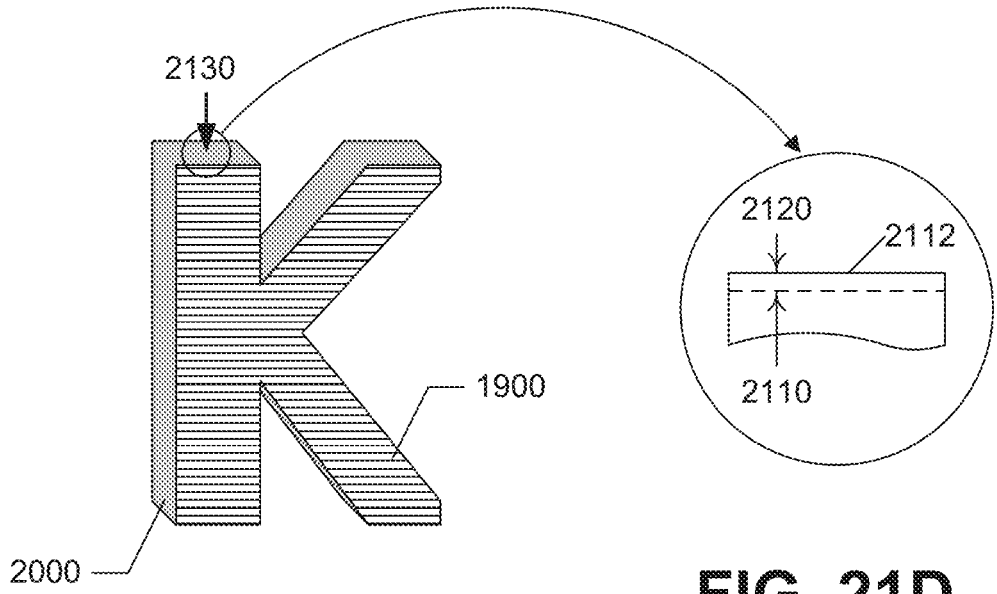
FIG. 21D
FIG. 21C
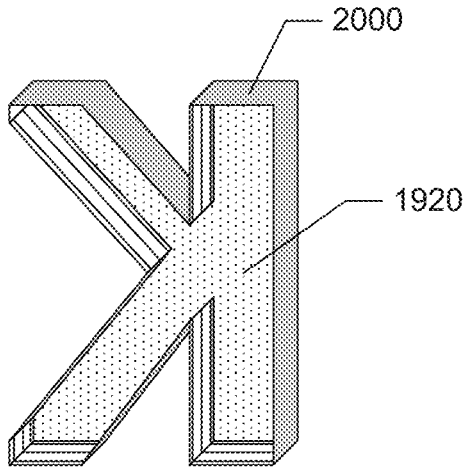
FIG. 21E

DEVICE AND METHOD FOR GENERATING CHANNEL LETTERS

CROSS-REFERENCE TO RELATED APPLICATIONS

This application is a continuation of U.S. patent application Ser. No. 13/458,883, filed Apr. 27, 2012, entitled "Generating Channel Letters Using Profiles," which is a continuation-in-part application of U.S. patent application Ser. No. 13/133,133, filed Jan. 10, 2012, and entitled "Methods and Apparatus for Cutting Profiles," which is a national stage entry of PCT Application No. PCT/US08/82371, filed Nov. 4, 2008. The disclosures of the above-referenced applications are incorporated herein by reference.

BACKGROUND

Field of the Invention

The present invention relates to channel letters, and more specifically, to generating channel letters using profiles.

Background

FIG. 1 shows a conventional machine 1 for folding a metal strip or rule 10 of a flat type into a predetermined shape. The structure and operation of a typical conventional machine is described in Korean Patent Registration No. 10-0233335, filed Nov. 20, 1996; Korean Patent Registration No. 10-388889, filed Apr. 3, 1999; U.S. Pat. No. 5,787,750, filed Jun. 21, 1996; and other related patents, all assigned to the same assignee as the present application. However, the conventional folding machine 1 shown in FIG. 1 can be used mostly for folding flat strip or rule 10. Thus, to fold a strip or rule of other shapes, a new design is desirable.

SUMMARY

Certain embodiments as disclosed herein provide for forming a channel letter box using a profile.

One aspect of the disclosure provides a method of forming a channel letter using a rule. The method can include determining at least one incision position on a first surface of the rule. The method can also include surface incising at the at least one incision position to create at least one surface incision on the first surface. The at least one surface incision can be oriented substantially transverse to a longitudinal axis of the rule and penetrate to a cut depth into the first surface of the rule. The cut depth can be less than a rule thickness. The method can also include folding the rule at the at least one incision position to form the channel letter. The first surface can be disposed on an inside of the channel letter and a second surface, opposite the first surface, being disposed on an outside of the channel letter.

Another aspect of the disclosure provides a method of forming a channel letter using a rule. The method can include determining at least one incision position and corresponding incision depth on a first surface of the rule. The method can also include surface incising at the at least one incision position and for the incision depth using a sawing unit, the sawing unit being configured to make a surface incision into the first surface in a direction substantially transverse to a longitudinal axis of the rule. The method can also include folding the rule at the incision position using a folding unit to form the channel letter, the first surface of the rule being on an inside of the channel letter.

Another aspect of the disclosure provides an apparatus for cutting a rule. The rule can have a first surface. The rule can also have a second surface opposite the first surface. The rule can also have a rule axis oriented along a longitudinal axis of the rule. The apparatus can have a cutter configured to make at least one surface incision on the first surface of the rule, the at least one surface incision extending in a direction substantially transverse to the rule axis and for a cut depth less than a rule thickness. The apparatus can also have a first drive unit configured to move the cutter in a plane perpendicular to the first surface to engage the cutter to the cut depth and subsequently disengage the cutter from the first surface. The rule can also have a second drive unit configured to move the cutter in a plane parallel to the first surface of the rule when the cutter is engaged with the first surface.

Other features and advantages of the present invention will become more readily apparent to those of ordinary skill in the art after reviewing the following detailed description and accompanying drawings.

BRIEF DESCRIPTION OF THE DRAWINGS

The details of the present invention, both as to its structure and operation, may be gleaned in part by study of the accompanying drawings.

FIG. 13E shows a process of fitting the trim over the completed channel letter.

FIG. 13F shows the completed letter box with the trim placed over the box.

FIG. 13G shows a gap left when the trim is placed over the channel letter.

FIG. 21C shows a channel letter box formed using profile with a top plate in place.

FIG. 21D shows in detail the snug and tight fit of the top plate into the channel letter box.

FIG. 21E shows the channel letter box looking forward from the back such that the rear view of the top plate is shown.

DETAILED DESCRIPTION

Certain embodiments as disclosed herein provide methods and apparatus for cutting profiles. In some embodiments, methods and apparatus described herein provide for cutting and folding profiles to make channel letters for a sign board. References will be made in detail to these embodiments including examples illustrated in the accompanying drawings. Technical structure and operation of the device will be described with reference to the drawings in FIGS. 2 through 24.

Figure 1:
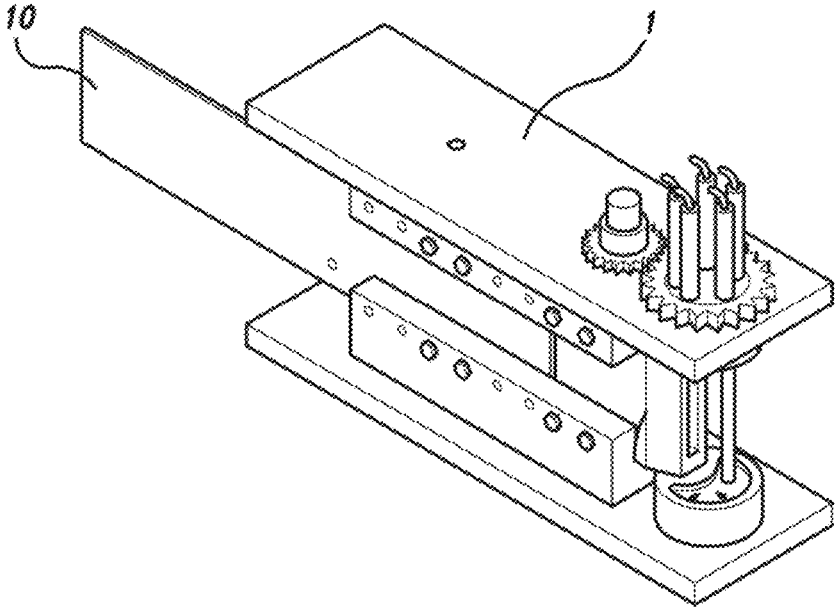
FIG. 1 (PRIOR ART)
FIG. 1 is a perspective view illustrating a conventional folding machine.

As described above, conventional folding machines have structural difficulties in folding metal rules (or strips) of shapes that are not flat. For example, the conventional folding machine shown in FIG. 1 would have difficulty folding metal rule 110 that has protruding ribs or tabs 110*a* and 110*b*, which protrude out of one side of the metal rule at top and bottom ends, as shown in FIG. 2, for example.

Figure 2:
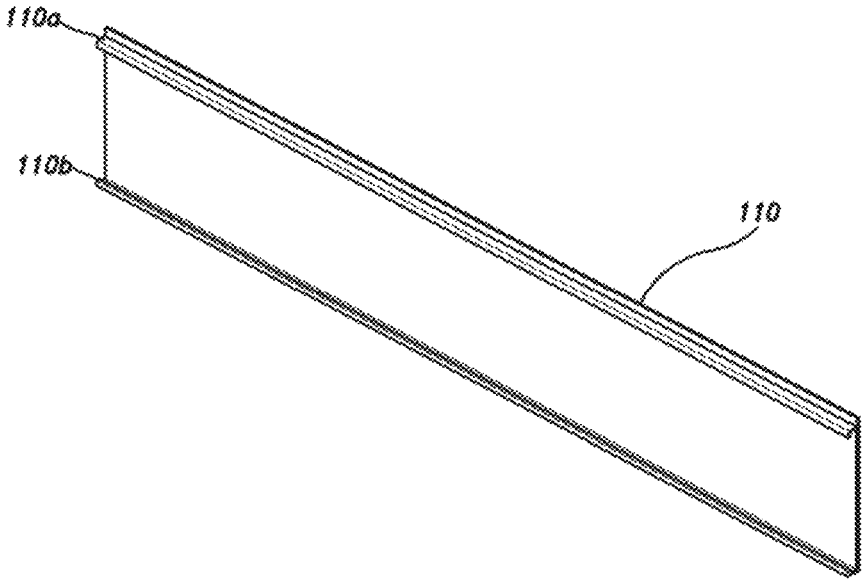
FIG. 2 illustrates a profile including protruding ribs.

In some embodiments, the metal rule (or other rigid material) of the shape illustrated in FIG. 2 can be used to make channel letters for sign boards. In sign board applications, the material that is used to make channel letters, as shown in FIG. 2, is sometimes referred to as "profile". Further, the profile is usually made of metallic material but can be made of aluminum, other rigid/semi-rigid material, or combination of both. Accordingly, the term "profile" is used throughout this disclosure to mean board or strip having ribs or tabs, and is made of metallic and/or other rigid/semi-rigid material.

In one embodiment, the protruding rib 110*b* that protrudes out at the bottom end is used to insert or place a front panel once the metal rule 110 has been folded into a desired shape or letter. The protruding rib 110*a* that protrudes out at the top end can be used to insert or place a back panel once the metal rule 110 has been folded into a desired shape or letter.

Figure 3:
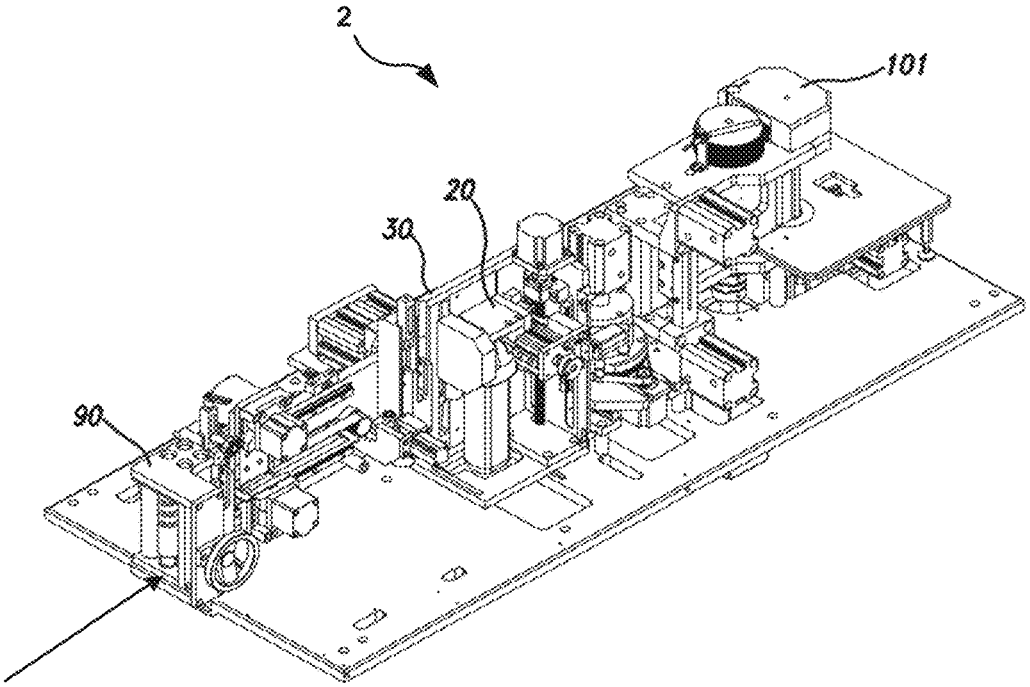
FIG. 3 illustrates a folding machine including a profile supply unit, a profile feeding path, a cutting unit, and a profile folding unit in accordance with one embodiment of the present invention.

FIG. 3 illustrates a folding machine 2 including a profile supply unit 90, a profile feeding path 30, a cutting unit 20, and a profile folding unit 101 in accordance with one embodiment of the present invention. The cutting unit 20 is provided near the profile feeding path 30 to cut a portion of the protruding ribs 110*a* and 110*b* in an angle to facilitate folding of the profile. The folding machine 2 of FIG. 3 is configured to fold the profile having protruding ribs 110*a* and 110*b* protruding out of one side of the metal rule at top and bottom ends, as shown in FIG. 2.

Figure 4:
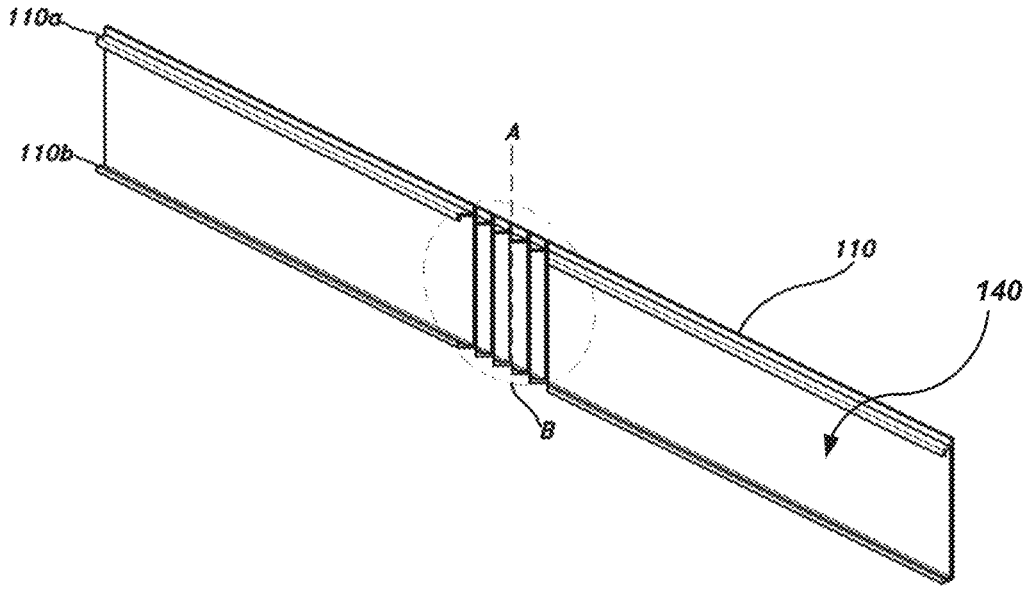
FIG. 4 shows the profile with a portion (see Part B) of protruding ribs cut in a predetermined shape on both sides of the folding line (see Line A)

To describe the cutting and folding process in detail, FIG. 4, for example, shows a profile 110 having protruding ribs 110*a* and 110*b*. This profile 110 is fed into the folding machine 2 through a profile supply unit 90, and is transferred through the profile feeding path 30 in the direction shown in FIG. 3. While the profile 110 is being transferred through the profile feeding path 30, a portion of the protruding ribs 110*a* and 110*b* is cut in an angle by the cutting unit 20 to facilitate the folding of the profile 110. Once the profile 110 is properly cut by the cutting unit 20, the profile folding unit 101 folds the cut profile 110.

FIG. 4 shows the portion (see Part B) of the protruding ribs 110*a* and 110*b* cut in a predetermined shape on both sides of the folding line (see Line A). Thus, in the illustrated embodiment of FIG. 4, in anticipation of the profile 110 being folded along Line A, the cutting unit 20 provides two "V" cuts on each side of Line A and one "V" cut centered at Line A, for a total of five "V" cuts. Although cuts in this embodiment are described as five "V" cuts, any shape and/or any number of cuts can be made on the ribs to facilitate the folding process. For example, five "V" cuts can provide easy folding of the profile 110 into approximately 300-degree angle (see angle C in FIG. 5). However, less or more number of cuts can provide easy folding of the profile 110 into angles less than or greater than 300 degrees. Further, the cut shape can be made in "U" shape or any other appropriate shape rather than a "V" shape. In other embodiments, the size of the V cut can be controlled to determine the angle of the fold.

Figure 4A:
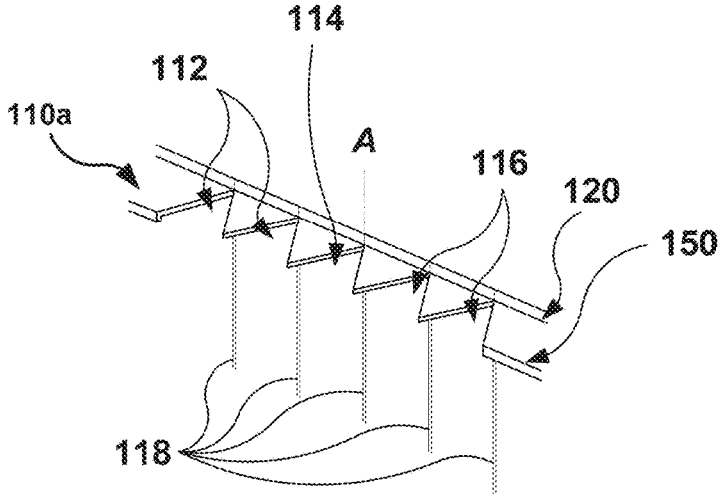
FIG. 4A shows Part B of FIG. 4 in more detail.

To further describe the cutting process in detail, the cutting portion (Part B) of the profile 110 is shown in detail in FIG. 4A. In the illustrated embodiment of FIG. 4A, when it is desired to fold the profile 110 along Line A, two cuts 112 are made on the left side of Line A. Another cut 114 is made centered at Line A. Then, two more cuts 116 are made on the right side of Line A, as shown. In some embodiments, scratch lines or cut lines 118 are made along the center of the cuts 112, 114, 116 to further facilitate the folding of the profile 110. The scratch lines 118 are made carefully on the same side of the profile as the protruding ribs 110*a* and 110*b* so that profile 110 can be folded along those lines without cutting the profile 110 at those lines. Seen in detail in FIG. 4A, the scratch lines 118 make tiny ridges on the surface of the profile 110. In one example, the depth of the ridges made by the scratch lines 118 is approximately one-third of the thickness of the profile. This leaves approximately two-thirds of the thickness of the profile for easier folding with completely cutting the profile. Further, in the illustrated embodiment of FIG. 4A, the V cuts are made on both ribs 110*a* and 110*b* so that the tip of the V shape cuts from the open edge 150 all the way to the closed edge 120 of the ribs 110*a* and 110*b*, and can penetrate slightly further into the profile to match with the tiny ridges made by the scratch lines 118. Generally, the cuts made on the rib are angled so that the open edge 150 has a larger angle than the closed edge 120.

Figure 5:
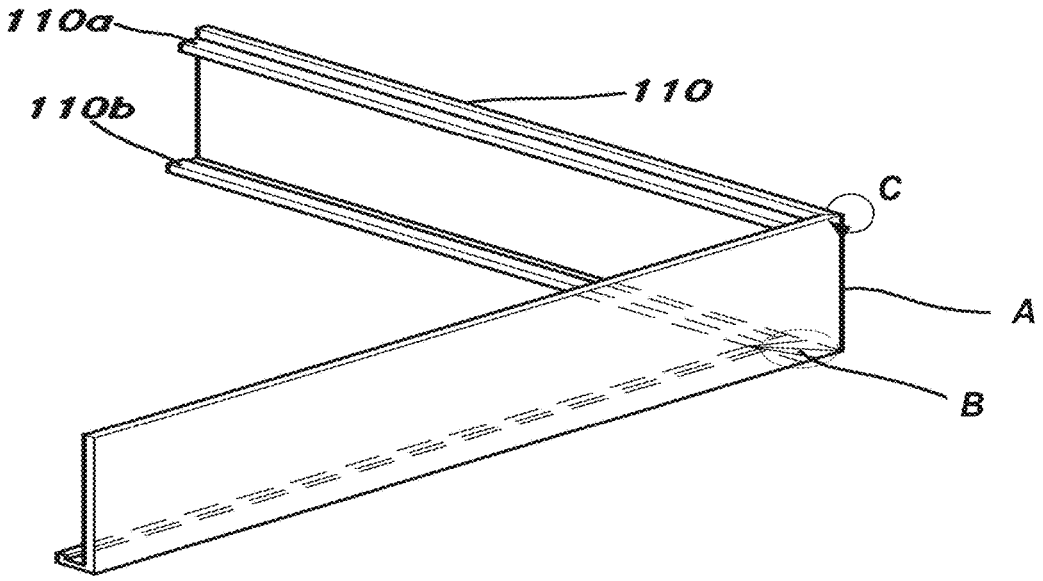
FIG. 5 shows one example of a desired fold shape of the profile after being cut in the cutting process described with respect to FIG. 4 and FIG. 4A, and folded along Line A for angle C.

FIG. 5 shows one example of the desired fold shape of the profile 110 after being cut in the cutting process described above with respect to FIG. 4 and FIG. 4A, and folded along Line A for angle C. Thus, the illustrated embodiment of FIG. 5 shows that the profile 110 can be easily folded into a desired angle because of the cuts made in the ribs 110*a* and 110*b* and the surface of the profile 110. Thus, it can be seen that by making different angle cuts on the ribs 110*a* and 110*b* and the scratch lines 118 on the surface 140 of the profile 110, any shape of channel letters can be easily produced using profiles.

Figure 6:
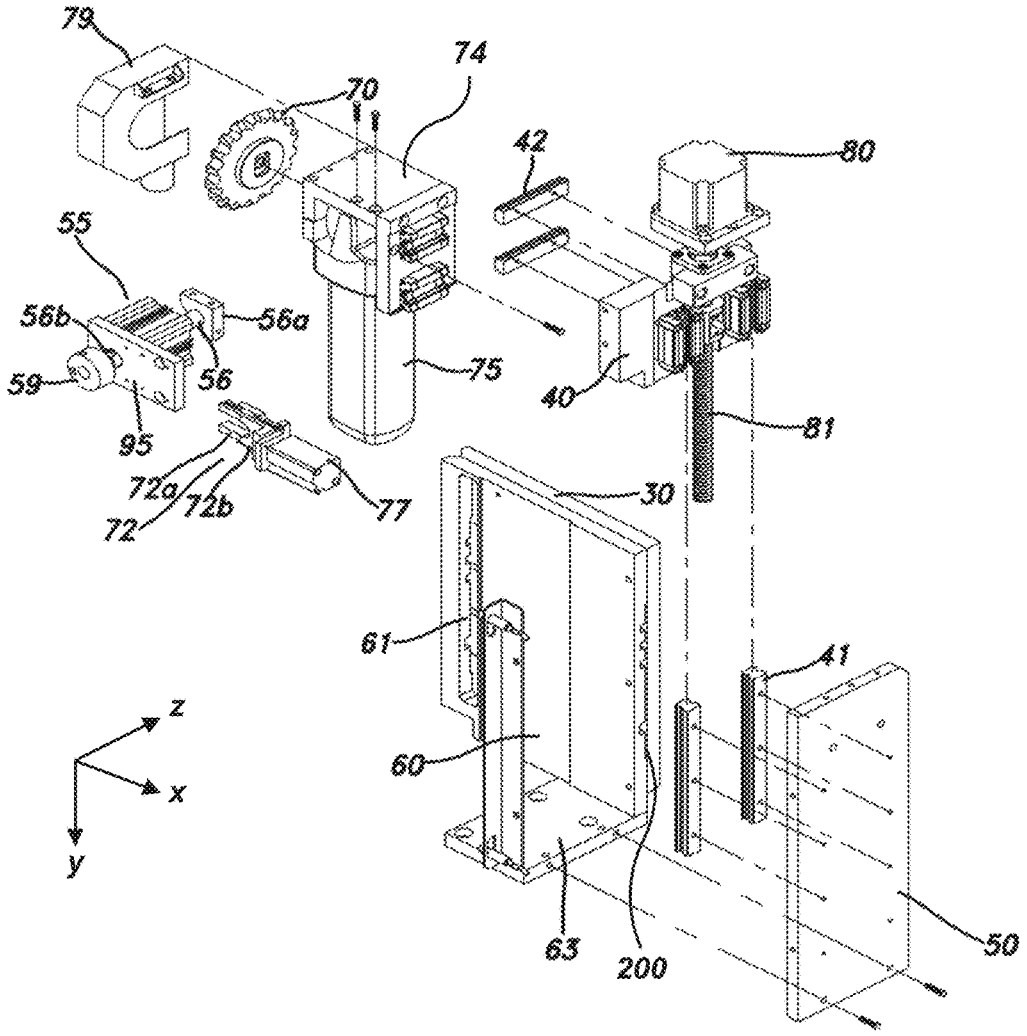
FIG. 6 shows an exploded view of the cutting unit in accordance with one embodiment of the present invention.
Figure 7:
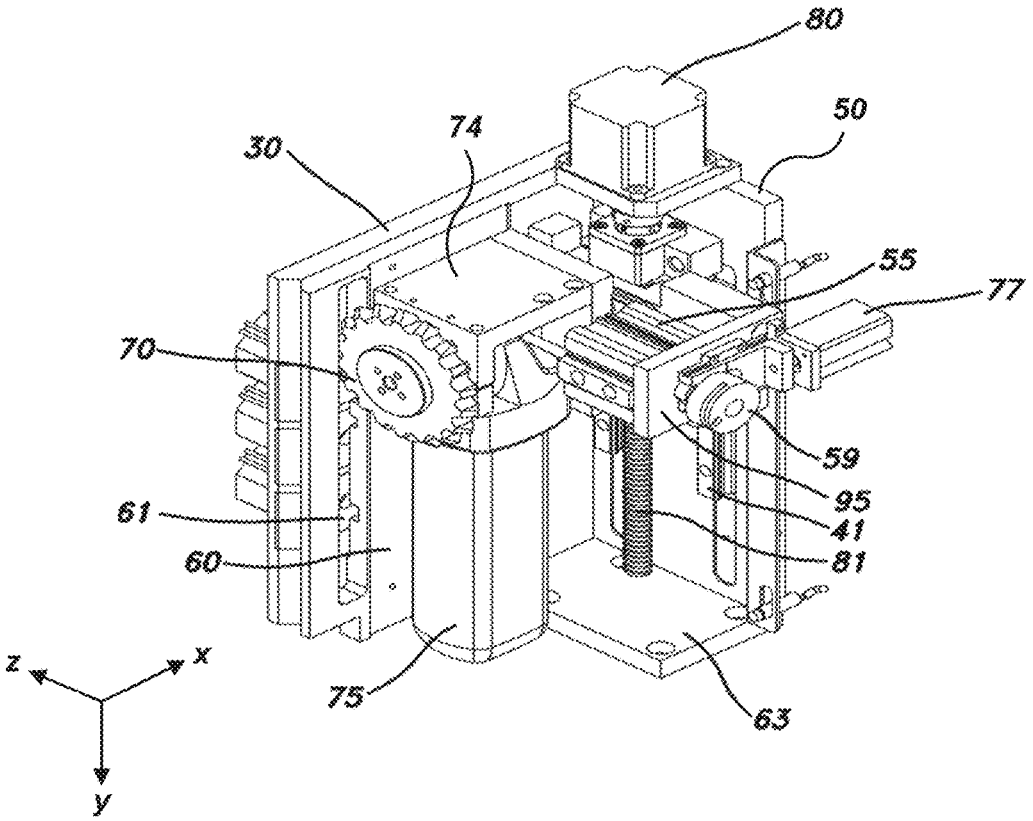
FIG. 7 shows a perspective view of the cutting unit with a cutter in an engaged position.
Figure 8:
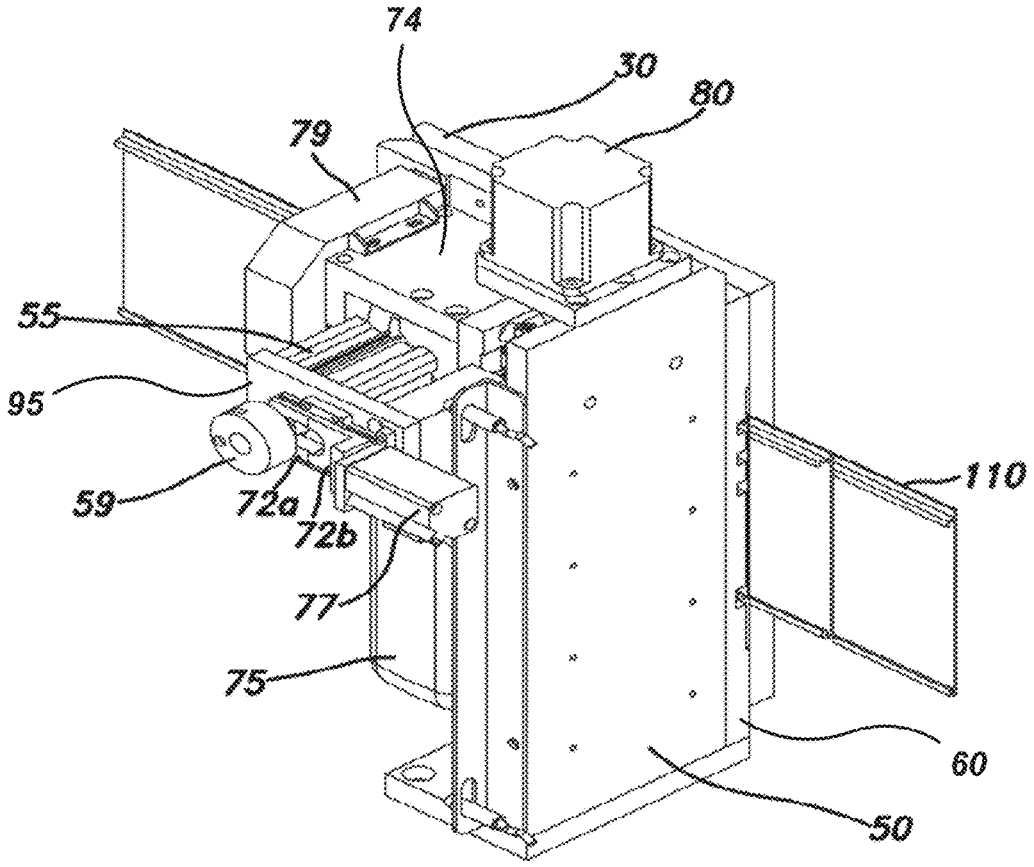
FIG. 8 shows another perspective view of the cutting unit with a cover over the cutter and a profile in position for cutting.

FIG. 6 shows an exploded view of the cutting unit 20 in accordance with one embodiment of the present invention. FIG. 7 shows a perspective view of the cutting unit 20 with a cutter 70 in an engaged position. FIG. 8 shows another perspective view of the cutting unit 20 with a cover 79 over the cutter 70 and a profile 110 in position for cutting.

In the illustrated embodiment of FIG. 6 through FIG. 8, the cutting unit 20 includes a frame 60 coupled to the profile feeding path 30, wherein the frame 60 and the profile feeding path 30 form a slit 200 through which a profile with protruding ribs can be fed. The cutting unit 20 also includes a fixing plate 50 which forms a plate for attaching other parts of the cutting unit 20. Also, a bottom plate 63 is fixed to the bottom end of the fixing plate 50. The frame 60 is provided with an opening 61 to allow a cutter 70 to move forward and backward (along Z axis) through the opening 61 to make cuts (similar to cuts 112, 114, 116) in the ribs 110*a* and 110*b* of a profile 110. The shape of the opening 61 also allows the cutter 70 to move up and down (along Y axis) to make scratch lines (similar to scratch lines 118). However, it is understood that the cutter movement forward and backward along Z axis can provide cuts in the ribs or make scratch line, and that the cutter movement up and down along Y axis can also provide cuts in the ribs or make scratch lines. In the illustrated embodiment of FIG. 6 through FIG. 8, the shape of the cutter 70 is configured so that it makes a V-shape cut in the ribs. However, cutters of other shapes can be configured to cut other shapes such as a U-shape cut.

In the illustrated embodiment of FIG. 6 through FIG. 8, a Y-axis slide rail 41 is provided on the fixing plate 50 along the Y-axis direction, and a moving plate 40 is attached to the Y-axis slide rail 41, which moves the moving plate 40 up and down along Y-axis. A screw driving motor 80 is coupled to the moving plate 40 to drive a vertical axis screw 81 which is threaded into the moving plate 40. Thus, the vertical axis screw 81 is rotated by the driving motor 80 in a direction parallel to the Y-axis slide rail 41. The lower end of the vertical axis screw 81 is configured to rest on top of the bottom plate 63. Since the screw driving motor 80 and the vertical axis screw 81 are coupled to the moving plate 40, as described above, the screw driving motor 80 drives the moving plate 40 up and down along the Y-axis direction parallel to the Y-axis slide rail 41.

The cutting unit 20 also includes a cutter driving motor 75, a Z-axis slide rail 42, a first cylinder 55, a support member 95, a bi-directional rod 56, a securing wheel 59, a stopper 72, and a second cylinder 77. The cutter driving motor 75 drives the cutter 70, and is fixed to the sidewall of the moving plate 40 using the Z-axis slide rail 42. Thus, the Z-axis slide rail 42 allows the first cylinder 55 to drive the cutter driving motor 75 forward and backward along the Z-axis direction. The first cylinder 55 is coupled to the support member 95, which is in turn coupled to one side of the moving plate 40. The first cylinder 55 drives the bi-directional rod 56 through its opening to move the cutter driving motor 75 along the Z-axis direction. The rod 56 includes an inner rod 56*a* and an outer rod 56*b*, which are formed as a single body. The inner rod 56*a* is coupled to the cutter driving motor 75, while the outer rod 56*b* passes through the support member 95 and is coupled to the securing wheel 59. The stopper 72 is designed to provide a multi-level depth control in such a way that the movement of the cutter driving motor 75 along the Z-axis direction can be controlled. In the illustrated embodiment of FIG. 6 through FIG. 8, the stopper 72 is designed for only two depth levels between the securing wheel 59 and the support member 95. The stopper 72 is connected to a rod of the second cylinder 77, and is fixed to one side of the support member 95.

In the illustrated embodiment of FIG. 6 through FIG. 8, the cutter 70 is also coupled to the cutter driving motor 75 through a cutter axis rod 73. The cutter 70 is configured to be driven by the cutter driving motor 75 which rotates the cutter 70 using the cutter axis rod 73. A cover 79 partially covers the cutter 73, wherein uncovered side of the cutter 73 is configured to face the profile 110 through the opening 61 for cutting the profile. The cover 79 is fixed to the body 74 of the cutter driving motor 75.

Elements of the cutting unit 20 described in FIG. 6 through FIG. 8 can be assigned as follows in a general description: a cutting apparatus 20 for cutting a profile, including: a cutter 70 configured to make cuts on the profile 110, wherein the profile 110 has a first surface 140 and a second surface, the profile 110 has at least one rib 110*a* and 110*b* on the first surface 140, and the cuts are made on the first surface 140; a first drive unit 55, 56, 42, 59, 77, 72 to drive the cutter 70 forward and backward to and from the first surface 140 of the profile 110; and a second drive unit 80, 81, 40, 41 to drive the cutter 70 up and down on the first surface 140 of the profile 110.

Figure 9:
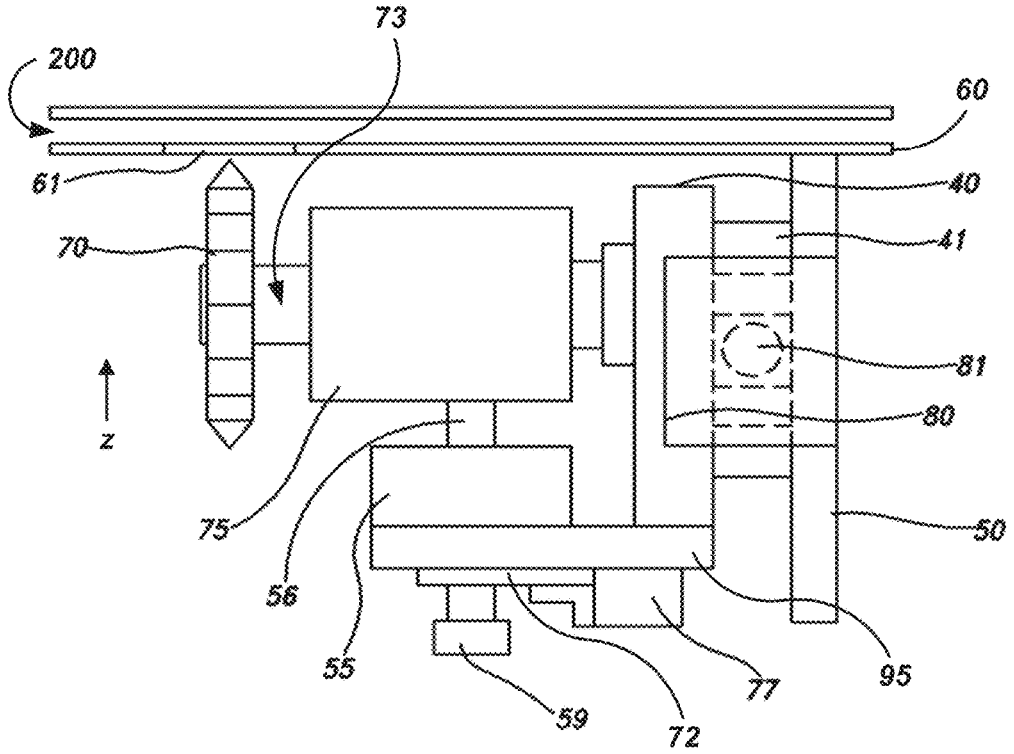
FIG. 9 shows the cutting unit prior to engaging the profile for cutting.
Figure 10:
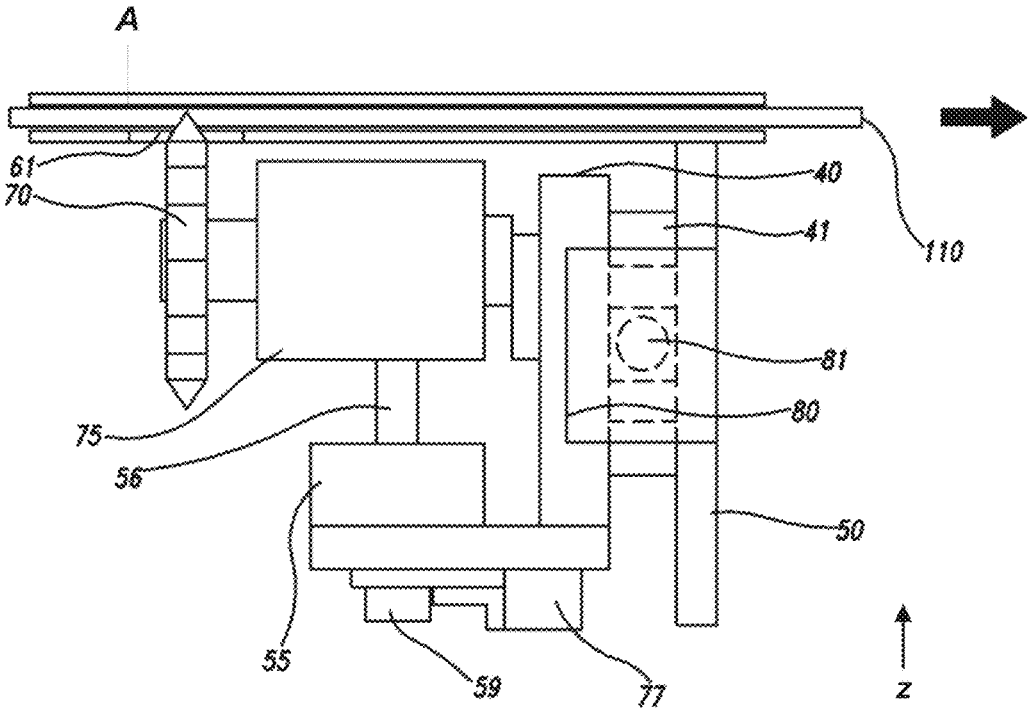
FIG. 10 shows the cutting unit in an engaged position for cutting the profile.
Figure 11:
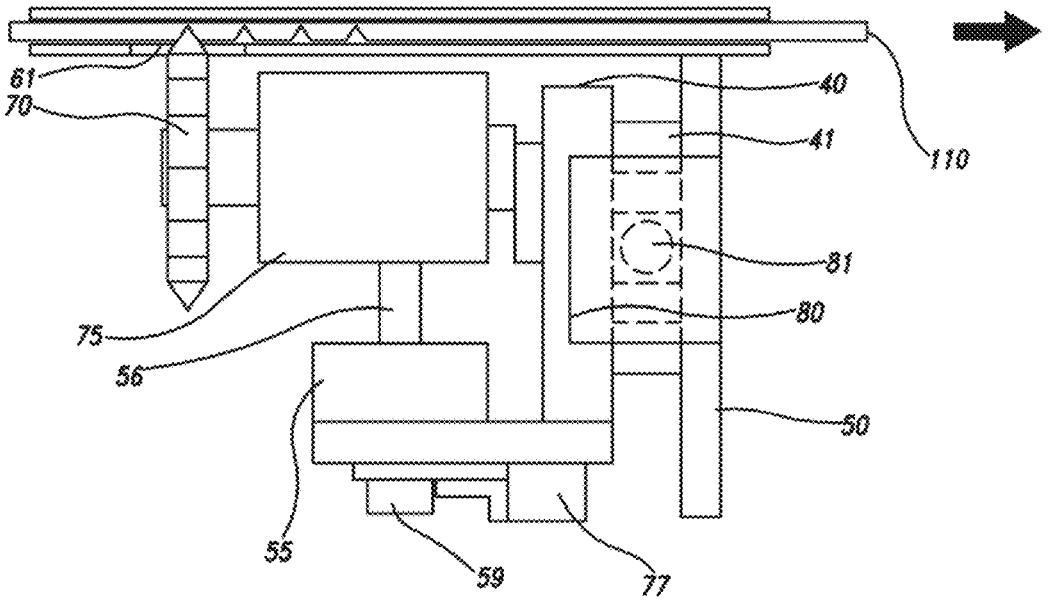
FIG. 11 shows the cutting unit in another engaged position for cutting the profile, wherein the profile is moved at a predetermined interval.

FIG. 9 through FIG. 11 illustrate a process of cutting the profile in accordance with one embodiment of the present invention. FIG. 9 shows the cutting unit 20 prior to engaging the profile for cutting. FIG. 10 shows the cutting unit 20 in an engaged position for cutting the profile 110. FIG. 11 shows the cutting unit 20 in another engaged position for cutting the profile 110, wherein the profile 110 is moved at a predetermined interval.

Figure 9A:
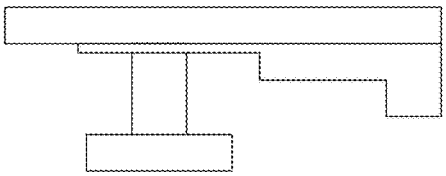
FIG. 9A shows thin front end of a stopper positioned between a securing wheel and a support member.
Figure 9B:
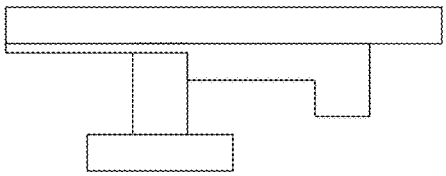
FIG. 9B shows thick rear end of a stopper positioned between a securing wheel and a support member.

At the initial stage of the cutting process (as shown in FIG. 9), the depth of a cut to be made on the ribs of the profiles is determined. Once the cutting depth is determined, the distance by which the cutter driving motor 75, and hence the cutter 70, is to be moved forward in the Z-axis direction can be set by the positioning of the stopper 72 between the securing wheel 59 and the support member 95. For example, if the cutting depth to be made on the profile 110 is set as a deep cut, then a second cylinder 77 is driven so that a thin front end 72*a* of the stopper 72 is positioned between the securing wheel 59 and the support member 95 (see FIG. 9A) so that the cutter 70 can be moved forward deeply into the profile along the Z-axis direction. However, if the cutting depth to be made on the profile 110 is set as a shallow cut, then a second cylinder 77 is driven so that a thick rear end 72*b* of the stopper 72 is positioned between the securing wheel 59 and the support member 95 (see FIG. 9B) so that the cutter 70 can be moved forward less than when the thin front end 72*a* is used. When moving the stopper 72 between positions shown in FIG. 9A and FIG. 9B, the second cylinder 77 should be driven only during a state where the cylinder rod 56 connected to the cutter driving motor 75 is moved in a direction opposite the Z-axis direction (i.e., the negative-Z direction) so that there is enough space along the cylinder rod 56 between the securing wheel 59 and the support member 95 for the stopper 72 to be moved in.

Once the cutting depth has been determined and an appropriate stopper 72 has been selected and engaged, the profile 110 is then fed through the slit 200 until Line A (see FIG. 4) reaches a predetermined point near the opening 61, as shown in FIG. 10. Once the profile 110 has reached and come to a rest at an initial cutting position, the first cylinder 55 is driven to push the rod 56 toward the profile feeding path 30, thereby moving the cutter driving motor 75 and, in turn, the cutter 70 forward in the Z-axis direction. The cutter 70 is then rotated and moved through the opening 61 to cut into the profile 110 for a predetermined cutting depth. If the cutter 70 is initially positioned at the top end of the profile 110 to make a cut at the top of the profile 110, then the screw driving motor 80 can now drive the moving plate 40 down along the Y-axis direction to move the cutter 70 down with it to make the scratch line 118 on the inside surface 140 of the profile 110 and the V cuts in the top rib 110*a* and the bottom rib 110*b* of the profile 110. When a cut along the first line (along the Y-axis direction) is completed, the cutter 70 returns to its original position as illustrated in FIG. 9. The profile 110 is moved at a predetermined interval as illustrated in FIG. 11.

In an alternative embodiment, the cutter 70 is initially positioned at the bottom end of the profile 110 to make a cut at the bottom of the profile 110, then the screw driving motor 80 now drives the moving plate 40 up along the Y-axis direction to move the cutter 70 up with it to make the scratch line 118 on the inside surface 140 of the profile 110 and the V cuts in the bottom rib 110*b* and the top rib 110*a* of the profile 110. Other embodiments with different orders for the above-described steps are also contemplated.

The above-described process can be summarized generally as follows: determining a cut depth of a cut to be made with a cutter on the profile; appropriately selecting and engaging a stopper to allow the cutter to cut the profile; receiving the profile for cutting; first moving the cutter forward for first cutting and/or backward for repositioning; second moving the cutter down and/or up for second cutting or repositioning; and repeating first moving and second moving according to a desired number of cuts.

Figure 12:
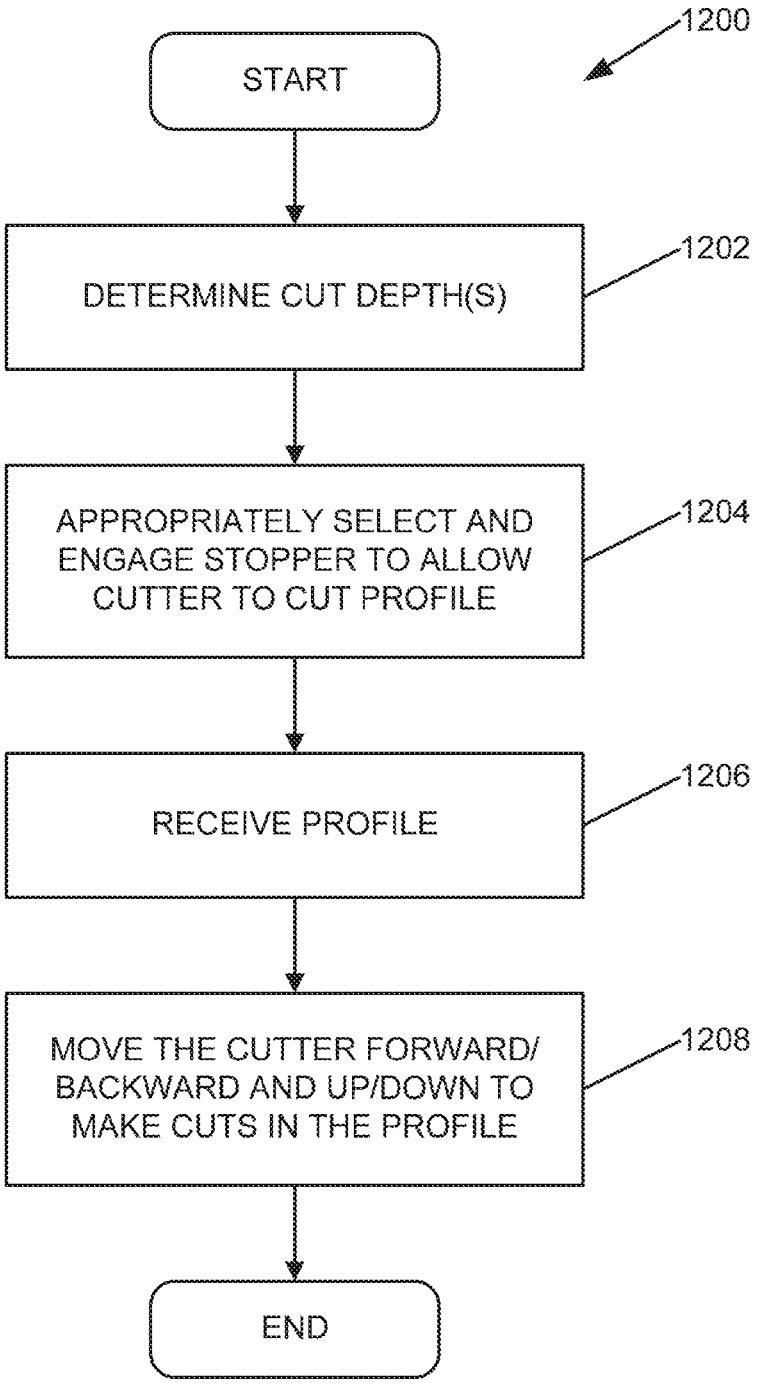
FIG. 12 is a flowchart illustrating a process of cutting the profile in accordance with one embodiment of the present invention.

FIG. 12 is a flowchart illustrating a process of cutting the profile in accordance with one embodiment of the present invention. At the initial stage of the cutting process, the depth of a cut to be made on the ribs of the profiles is determined (see Box 1202). Once the cutting depth is determined, the distance by which the cutter driving motor 75, and hence the cutter 70, is to be moved forward in the Z-axis direction can be set by the positioning of the stopper 72 between the securing wheel 59 and the support member 95, at Box 1204. Once the cutting depth has been determined and an appropriate stopper 72 has been selected and engaged, the profile 110 is then fed through the slit 200, at Box 1206, until Line A reaches a predetermined point near the opening 61.

Once the profile 110 has reached and come to a rest at an initial cutting position, the first cylinder 55 is driven to push the rod 56 toward the profile feeding path 30, thereby moving the cutter driving motor 75 and, in turn, the cutter 70 forward in the Z-axis direction, at Box 1208. The cutter 70 is then rotated and moved through the opening 61 to cut into the profile 110 for a predetermined cutting depth.

Figure 14A:
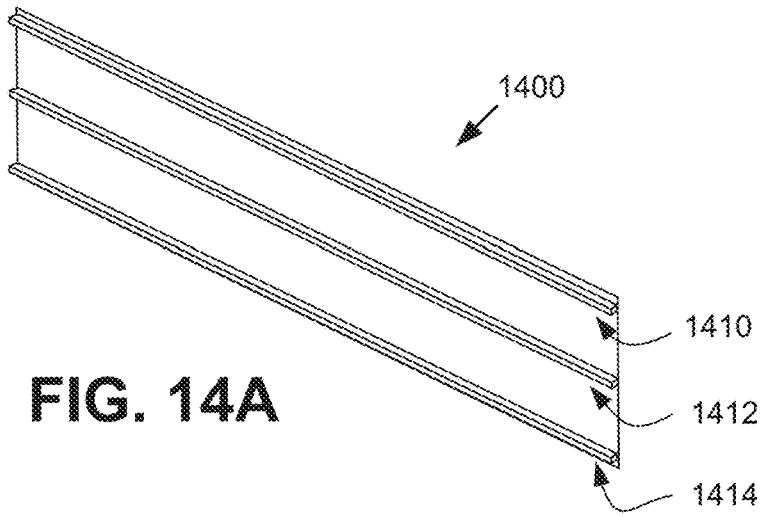
FIGS. 14A to 14C show three different embodiments of a profile having protruding ribs or tab that protrude out on one side.
Figure 14B:
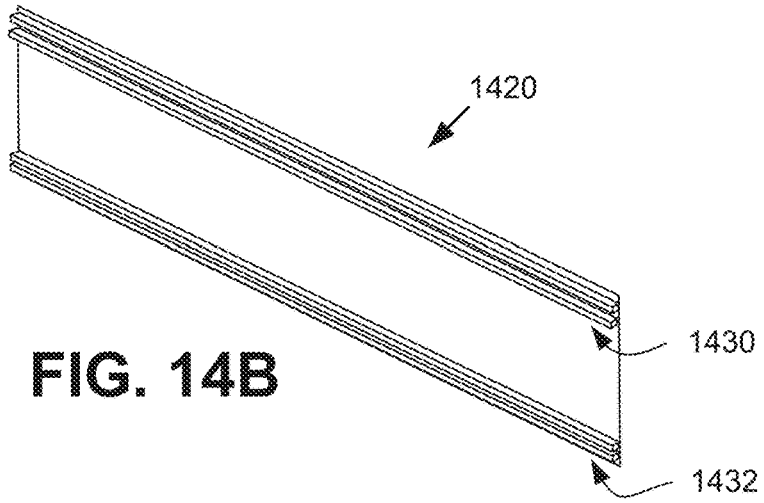
Figure 14C:
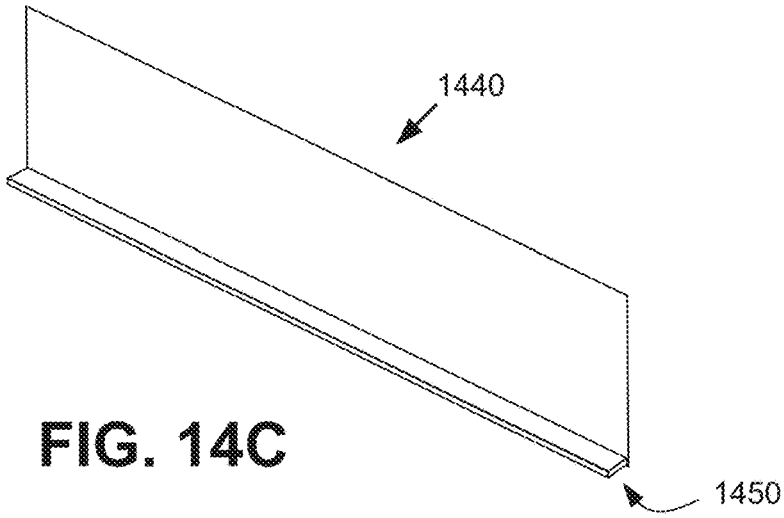

Certain embodiments as disclosed herein also provide for generating channel letters or shapes using profiles. Some embodiments provide for surface cutting and folding profiles to make channel letters and shapes for a sign board. In other embodiments, channel profiles are described. As used in this section, the term "rule" is used to refer to a strip of generally flat metallic material (although other material such as plastic can be used). The term "profile" is used to refer to a strip of generally more rigid metallic material (although other material such as plastic can be used) including protruding ribs or tabs as illustrated in FIGS. 14A through 14C and described below. References will be made in detail to these embodiments including examples illustrated in the accompanying drawings.

As described above, conventional folding machines have structural difficulties in folding metal rules (or strips) of shapes that are not flat. For example, the conventional folding machine shown in FIG. 1 would have difficulty folding metal strips or profiles (e.g., profiles 1400, 1420, 1440 shown in FIGS. 14A through 14C) having protruding ribs or tabs 1410-1414, 1430-1432, 1450, which protrude out of one side of the metal strip at top, middle, and/or bottom ends, for example. In addition to the protruding ribs or tabs, since the profiles are much more rigid and/or thicker than the rules (i.e., flat strips), the profiles are much more difficult to fold into channel letters or shapes. Therefore, a new method of folding the profile is needed.

Figure 13A:
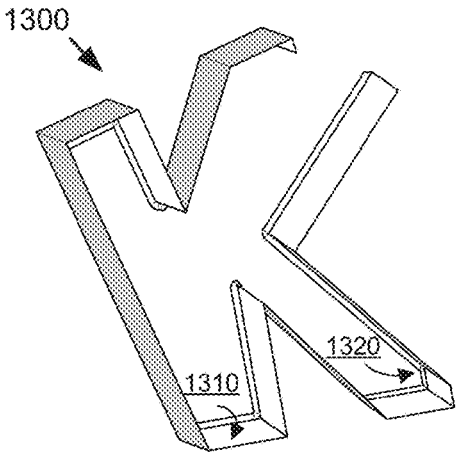
FIG. 13A shows a channel letter being formed using a flat strip.
Figure 13B:
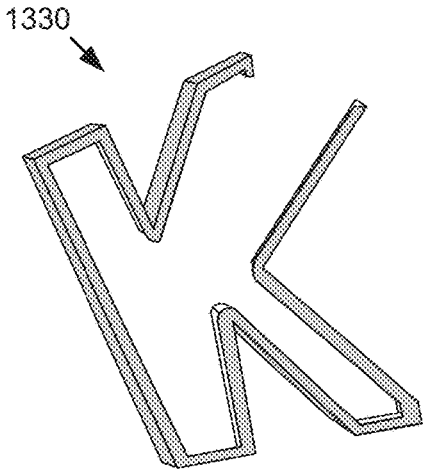
FIG. 13B shows a trim being formed using a flat strip.
Figure 13C:
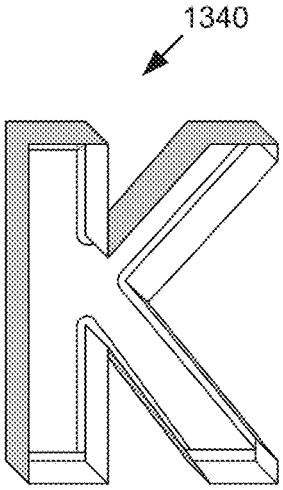
FIG. 13C shows a completed channel letter with a flange.
Figure 13D:
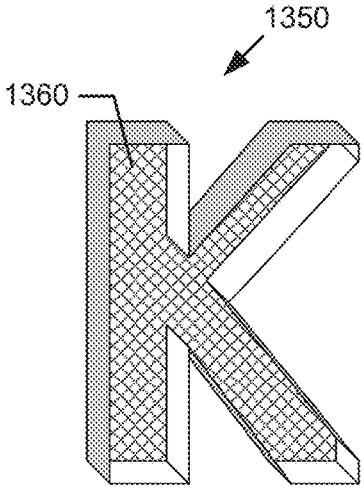
FIG. 13D shows a bottom panel inserted into the completed channel letter.

Further, using a flat strip to produce a channel letter (e.g., see 1300 of FIG. 13A) usually requires flanging 1310 (i.e., folding the bottom end of one side) and notching 1320 (i.e., cutting the flange into v-shape at appropriate points to allow the flange to be folded at the corners of the letter or shape) to hold the bottom panel. FIG. 13C shows the completed letter 1340 with the flange. FIG. 13D shows the bottom panel 1360 inserted into the completed letter 1350 with the flange holding the bottom panel so that the bottom panel is prevented from slipping through the letter or shape. Once the letter box (e.g., 1340, 1350) is completed, a trim or cap (e.g., 1330 of FIG. 13B or 13E) needs to be built to provide a cover. A top panel 1370 also needs to attach to the trim 1330. The attachment can be made using glue or other attaching material such as clip, nail, staple, or bond. Further, in order for the trim 1330 to fit over the letter box (e.g., 1372 of FIG. 13E), the measurements of the trim 1330 need to be slight larger than the measurements of the letter box 1372. FIG. 13F shows the completed letter box 1380 with the trim 1330 placed over the box 1380. However, even when the measurements of the trim 1330 are carefully made and cut, the folding process usually ends up leaving a gap 1382 when it is placed over the letter box 1380, as shown in FIG. 13G. Thus, when the channel letter box 1380 is displayed, the light escaping through the gap 1382 gets diffused, and the channel letter may look somewhat fuzzy and not too clear or crisp from a distance.

In some embodiments, the profiles of the shapes illustrated for example in FIGS. 14A through 14C can be used to make channel letters or shapes for sign boards. In sign board applications, the material used to make channel letters or shapes is sometimes referred to as "profile". Further, the profile is usually made of metallic material (e.g., tin, bronze, copper, zinc, steel, etc.) but can be made of aluminum, other rigid and/or semi-rigid material, or combination of both. Accordingly, the term "profile" is used throughout this disclosure to mean board or strip having ribs or tabs. In one embodiment, the profile is generated from a mold such that the profile and the ribs/tabs are formed into a single structure, which provides strength to the ribs or tabs. In another embodiment, the ribs or tabs are attached to one surface of the profile using an attachment means such as glue, solder, or bond. Example dimensions of the profile include approximately 0.6 to 2.0 mm in thickness (i.e., 1670 in FIG. 16B), 25 to 200 mm in height (i.e., 1650 in FIG. 16A), and additional 1 to 3 mm for the rib or tab (i.e., 1660 in FIG. 16B).

FIGS. 14A to 14C show three different embodiments of a profile 1400, 1420, 1440 having protruding ribs or tab 1410-1414, 1430-1432, 1450 that protrude out on one side. The profile 1400 shown in FIG. 14A has three ribs 1410, 1412, 1414 one each at the top, the middle, and the bottom of one side. The profile 1420 shown in FIG. 14B has two sets of ribs, one set of two ribs each at the top 1430 and the bottom 1432 of one side. The profile 1440 shown in FIG. 14C has one rib 1450 at the bottom of one side. Each of the three embodiments has different utilities for the rib(s). For example, for the profile 1400, the top rib 1410 can be used to hold the top plate and the bottom rib 1414 can fit into the bottom plate, as explained below. The middle rib 1412 can be used for various other purposes such as inserting a middle plate for different color LEDs.

Figure 15:
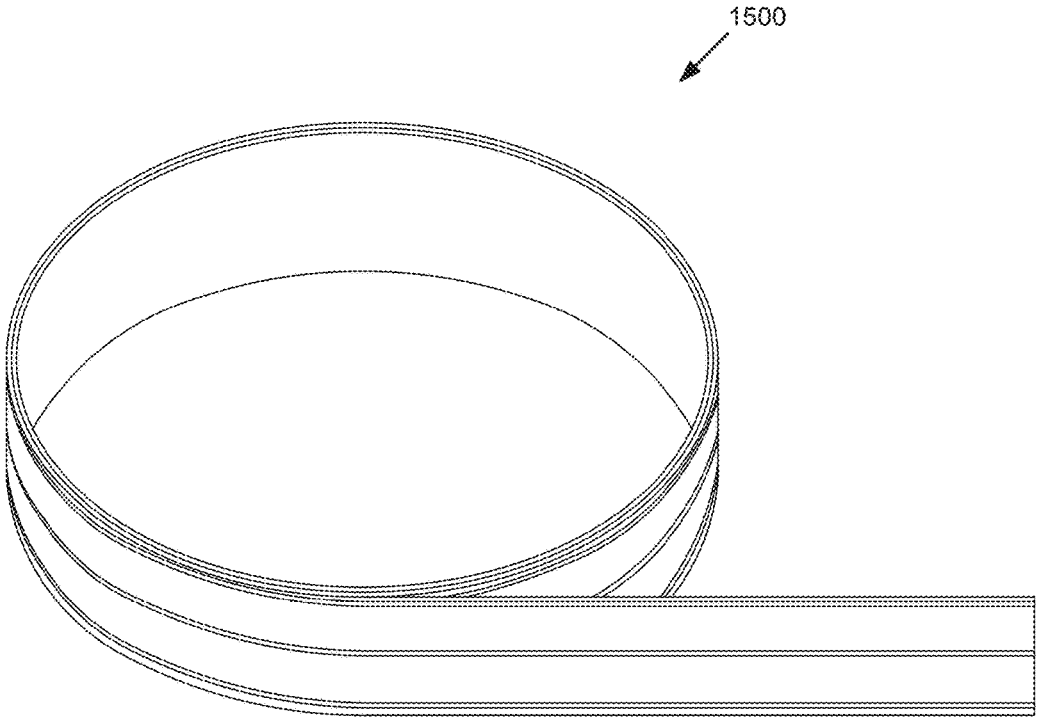
FIG. 15 illustrates a roll of profile configured to be fed into a folding machine for generating channel letters or shapes.

FIG. 15 illustrates a roll of profile 1500 configured to be fed into a folding machine for generating channel letters or shapes. In one embodiment, as the roll of profile 1500 is fed in, the folding machine first cuts the profile into an exact length for the intended channel letter or shape. In another embodiment, the profile can be folded first and then cut at the end.

Figure 16A:
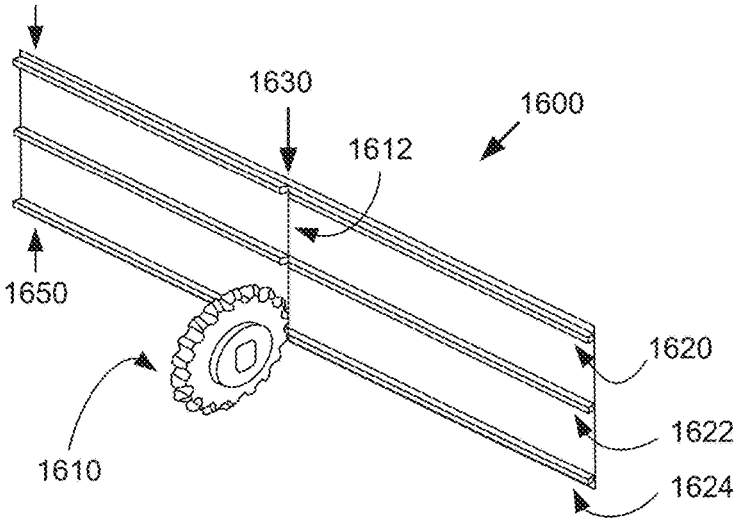
FIGS. 16A through 16C show surface incision in accordance with one embodiment of the present invention.
Figure 16B:
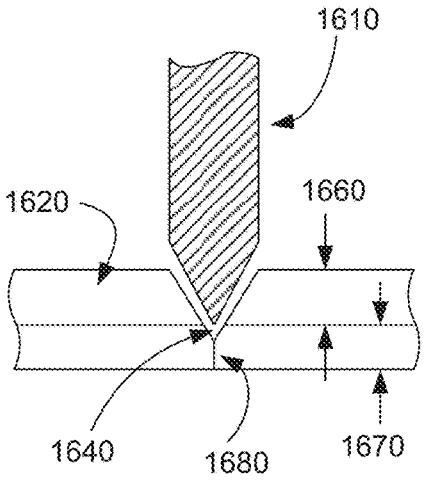
Figure 16C:
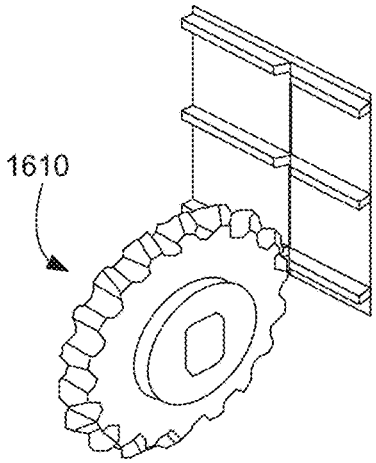

FIGS. 16A through 16C show surface incision (or surface engraving) in accordance with one embodiment of the present invention. Since profile 1600 is rigid and has protruding ribs 1620-1624, it would be difficult to accurately fold the profile 1600 along line 1612. In one embodiment, the rigidity comes from having the thickness 1670 (see FIG. 16B) of the profile 1600 to be larger than the thickness of the flat strip for an average rule. In one embodiment, the thickness of an average rule is in the range of 0.2 to 1.5 mm. Accordingly, in the illustrated embodiment of FIG. 16A, surface incision is made along the line 1612 of the profile 1600 using a sawing unit 1610 of the folding machine. The term "surface incision" is used here to refer to cutting along the surface of the profile 1600 without cutting the profile 1600 into two pieces.

FIG. 16B shows one example of surface incision of the profile 1600 viewed along line 1630 shown in FIG. 16A. Thus, in the illustrated embodiment of FIG. 16B, it can be seen that the sawing unit 1610 makes an incision along the line 1612 and makes v-cut into the protruding rib 1620 and partially into the surface of the profile 1600. This creates a ridge 1640 on the surface of the profile 1600 and makes the effective thickness 1680 of the resulting profile 1600 to be close to the thickness of an average rule. Accordingly, with the effective thickness 1680 of the profile 1600 made to be close to the thickness of an average rule along the line 1612, it is now easier to fold the profile 1600 along the line 1612. FIG. 16C shows a close-up of the surface incision being made by the sawing unit 1610.

Figure 17:
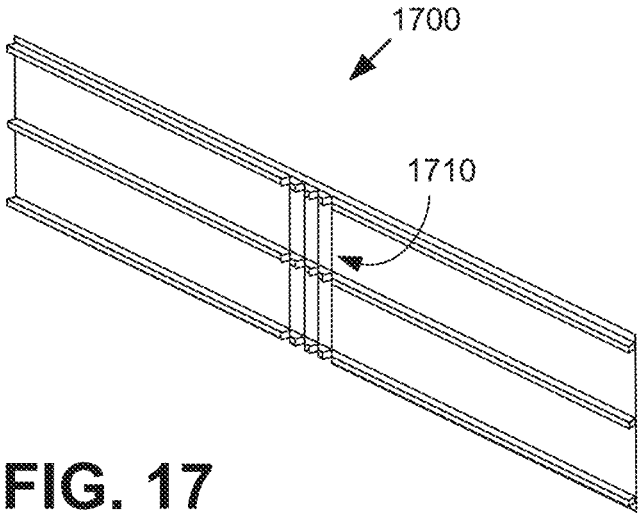
FIGS. 17 and 18 show multiple surface incisions made on one surface of the profile.
Figure 18:
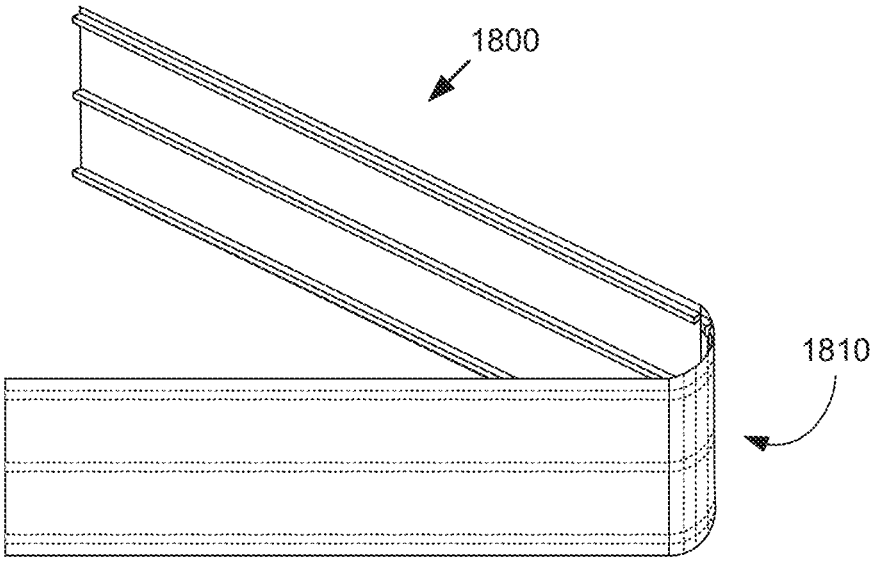

FIGS. 17 and 18 show multiple surface incisions 1710, 1810 made on the surface of the profile 1700, 1800. In the illustrated embodiment of FIG. 17, four surface incisions 1710 are made. Further, as illustrated in the embodiment of FIG. 18, multiple surface incisions 1810 are made to form a channel letter or shape that has curved or rounded corner(s). However, a more or less number of surface incisions can be made to vary the curvature of the rounded corner(s).

Figure 19A:
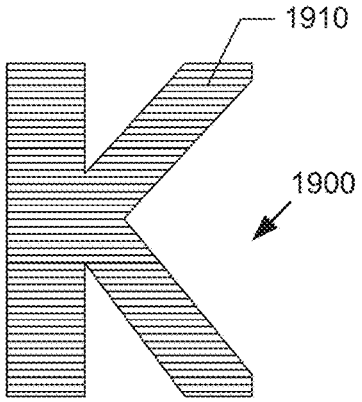
FIGS. 19A and 19B show front view and rear view, respectively, of a top plate.
Figure 19B:
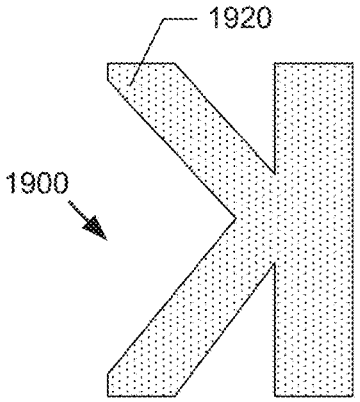

FIGS. 19A and 19B show front view 1910 and rear view 1920, respectively, of a top plate 1900. Since the top plate 1900 is cut to match the channel letter or shape rather than folded like the trim cover 1330 of FIGS. 13B, 13E, 13F, for example, the top plate 1900 can be formed more accurately than the trim cover 1330.

Figure 20A:
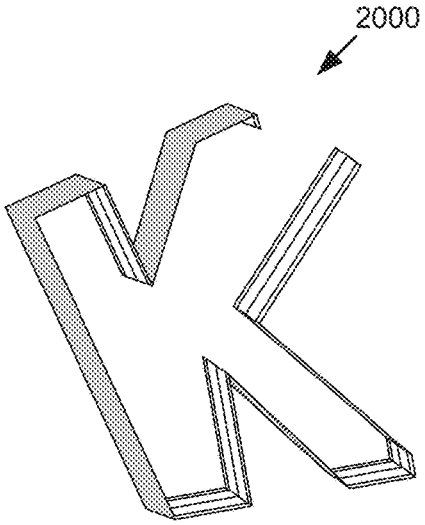
FIGS. 20A and 20B show a channel letter box made with a profile in accordance with one embodiment of the present invention.
Figure 20B:
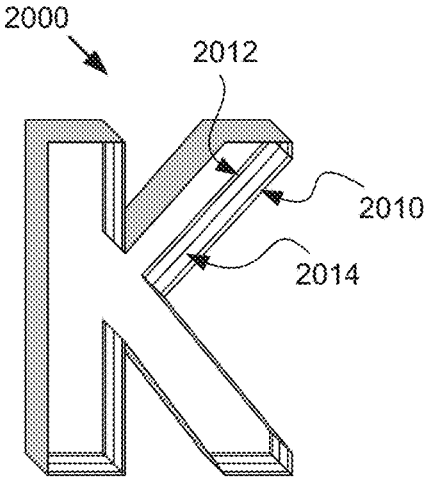

FIGS. 20A and 20B show a channel letter box 2000 made with a profile rather than with a rule, as shown in FIG. 13C. As can be seen in FIG. 20B, for example, the channel letter box 2000 includes top rib 2010 for retaining the top plate (e.g., 1900 of FIG. 19A or 19B) and bottom rib 2012 for fitting into a bottom plate (see FIG. 23B). As explained above, middle rib 2014 can be used for various other purposes such as inserting a middle plate for different color LEDs.

Figure 21A:
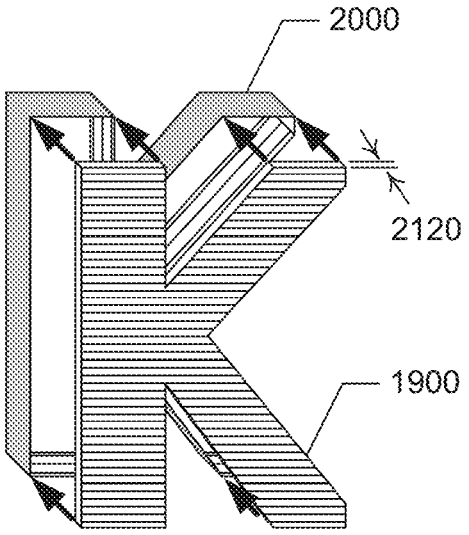
FIG. 21A shows a process of fitting a top plate into the channel letter box formed using profile.
Figure 21B:
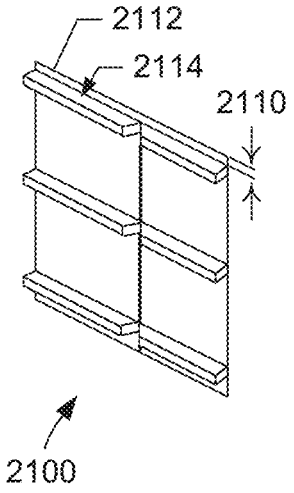
FIG. 21B shows relevant portion of a profile which can be used to form the channel letter box.

FIG. 21A shows the process of fitting the top plate 1900 into the channel letter box 2000. The fitting process may include attaching the top plate 1900 to the top rib of the channel letter box 2000 using glue or other attaching material such as clip, nail, staple, or bond. FIG. 21B shows relevant portion of a profile 2100 which can be used to form the channel letter box 2000. It should be noted that a desirable thickness 2120 of the top plate 1900 should be substantially close to the distance 2110 from the top 2112 of the profile to the top of the top rib 2114, as shown in FIG. 21B. Thus, as shown in FIG. 21C, if the desirable thickness 2120 of the top plate 1900 is substantially close to the distance 2110 shown in FIG. 21B, the top plate 1900 will fit snuggly and tightly into the channel letter box 2000 and the front surface of the top plate 1900 will be flush with the channel letter box 2000. The snug and tight fit fills any gap and prevents the light of the LEDs from escaping out and causing any blurring, smearing, or unwanted light intensity in the channel letter.

FIG. 21D show in detail the snug and tight fit of the top plate 1900 into the channel letter box 2000 (looking down onto the channel letter box 2000 and the top plate 1900 along the direction 2130 shown in FIG. 21C) so that the front surface of the top plate 1900 is flush with the channel letter box 2000. That is, FIG. 21D shows the thickness 2120 of the top plate 1900 being substantially equal to the distance 2110 so that the front surface of the top plate 1900 is at the same height as the top 2112 of the profile used to form the channel letter box 2000. FIG. 21E shows the channel letter box 2000 looking forward from the back such that the rear view 1920 of the top plate 1900 is shown.

Figure 22A:
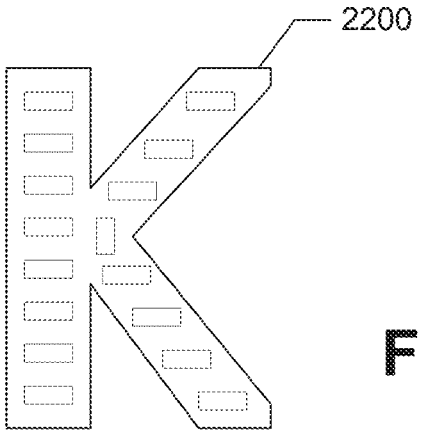
FIG. 22A shows a base plate with an arrangement of light emitting diodes (LEDs) disposed on top of the base plate in accordance with one embodiment of the present invention.
Figure 22B:
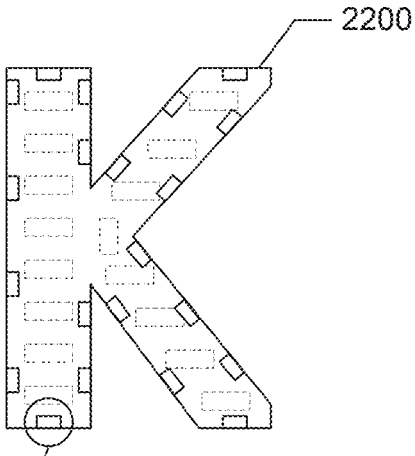
FIG. 22B shows the base plate with an arrangement of clips in accordance with one embodiment of the present invention.
Figure 22C:
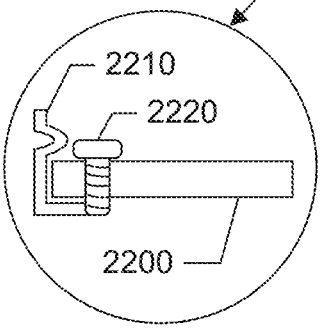
FIG. 22C shows a detailed view of a clip configured with the base plate and a screw in accordance with one implementation.

FIG. 22A shows a base plate 2200 with an arrangement of light emitting diodes (LEDs) disposed on top of the base plate 2200 in accordance with one embodiment of the present invention. Other embodiments can have the LEDs disposed in different arrangements. FIG. 22B shows the base plate 2200 with an arrangement of clips as shown. FIG. 22C shows a detailed view of a clip 2210 configured with the base plate 2200 and a screw 2220 in accordance with one implementation. In this embodiment, the base plate 2200 is first attached to a flat surface where the channel letter box is desired to be placed. Although only one arrangement is shown here, many different arrangements of clips used in conjunction with different configurations of profiles are possible.

Figure 23A:
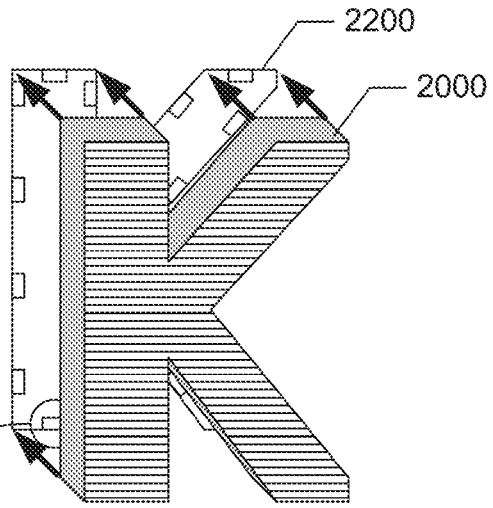
FIG. 23A shows a process of the channel letter box being placed over the base plate in accordance with one implementation of the present invention.
Figure 23B:
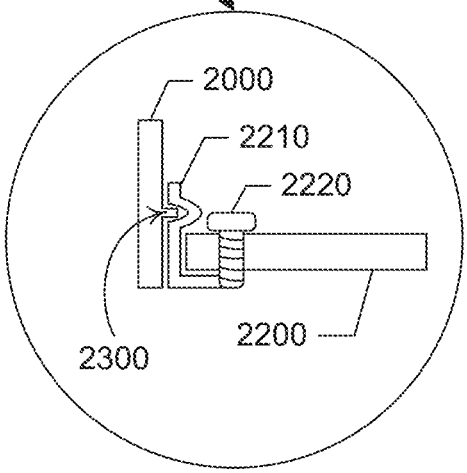
FIG. 23B is detailed view of attaching the channel letter box to the base plate by snapping the bottom tab of the channel letter box into an open slot of the clip.

FIG. 23A shows a process of the channel letter box 2000 being placed over the base plate 2200 in accordance with one implementation of the present invention. As can be seen on the detailed view of FIG. 23B, the channel letter box 2000 is attached to the base plate 2200 by snapping the bottom tab 2300 of the channel letter box 2000 into an open slot of the clip 2210 which is fixed to the flat surface by the screw 2220. The screw 2220 and the clip 2210 also keep the base plate 2200 in place.

Figure 24:
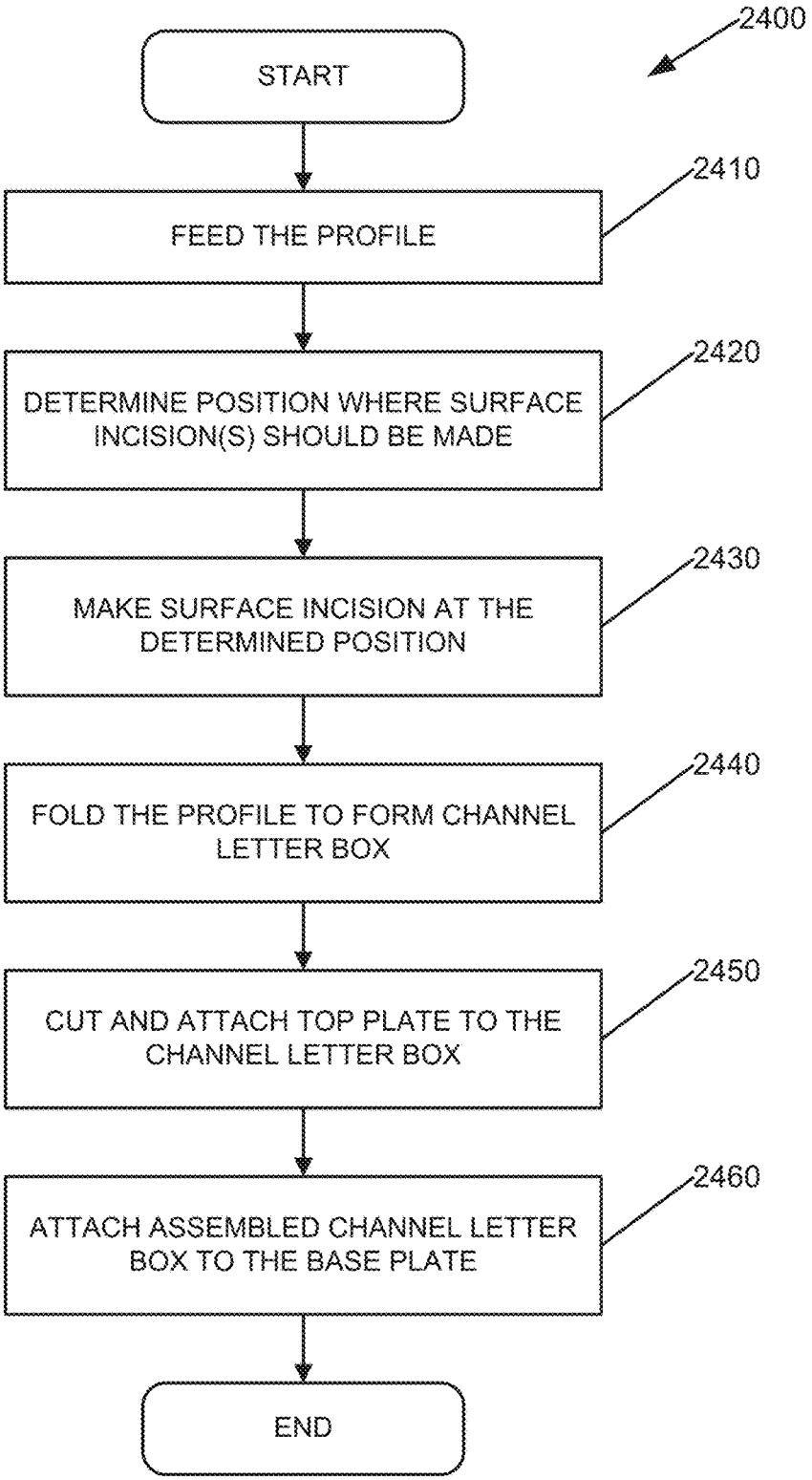
FIG. 24 shows a flowchart illustrating a method of forming a channel letter box using a profile according to one embodiment of the present invention.

FIG. 24 shows a flowchart 2400 illustrating a method of forming a channel letter box using a profile according to one embodiment of the present invention. The method includes feeding the profile, at box 2410, and determining a position where at least one surface incision is to be made, at box 2420. The term position can refer to a line or a plurality of lines (as explained above regarding multiple lines for making different curvatures). The surface incision is then made at the determined position, at box 2430. As explained above, the surface incision makes a cut along the position on one surface of the profile without cutting the profile into two pieces. The surface incision makes v-cut into protruding rib(s) and partially into the one surface of the profile. This creates a ridge on the surface of the profile and makes the effective thickness of the resulting profile along the position to be close to the thickness of an average rule to make it easier to fold the profile.

The profile, which includes at least one surface incision made on one surface, is folded, at box 2440, to form the channel letter box. A top plate is cut and attached to the channel letter box, at box 2450. As explained above, a desirable thickness of the top plate should be substantially close to the distance from the top of the profile to the top of the top rib. In this case, the top plate will fit snuggly and tightly into the channel letter box and the front surface of the top plate will be flush with the channel letter box. The assembled channel letter box is then attached to the base plate, at box 2460. As explained above, in one embodiment, the channel letter box is attached to the base plate by snapping the bottom tab of the channel letter box into an open slot of a clip which is fixed to a flat surface by a screw. The screw and the clip also keep the base plate in place.

The foregoing embodiments are merely presented as examples and are not to be construed as limiting the present invention. The present teachings can be readily applied to other types of methods, apparatus and/or devices. In other embodiments, the teachings embodied in the method(s) can also be implemented as computer programs stored in non-transitory storage medium. The description of the present invention is intended to be illustrative, and not to limit the scope of the claims. Many alternatives, modifications, and variations will be apparent to those skilled in the art.

What is claimed is:

1. A method of forming a channel letter using a rule, the method comprising:

determining at least one incision position on the rule, the rule having first and second surfaces forming a side of the channel letter;

selecting a surface incision angle to enable the rule to be folded by the surface incision angle so that the rule can be folded into a desired channel letter shape;

surface incising, using a sawing unit, at the at least one incision position by the surface incision angle to create at least one surface incision on the first surface, the at least one surface incision oriented substantially transverse to a longitudinal axis of the rule and penetrating a cut depth into an entire width of the first surface of the rule, the cut depth being less than a rule thickness, the longitudinal axis of the rule being an axis along which the rule is fed into a rule bending device, wherein surface incising includes determining a number of incisions to make at the at least one incision position to form the desired channel letter shape;

folding the rule at the at least one incision position to form the channel letter, the first surface being disposed on an inside of the channel letter and the second surface, opposite the first surface, being disposed on an outside of the channel letter.

2. The method of claim 1 wherein the at least one surface incision removes a portion of the rule at the incision position allowing a fold at the incision position.

3. The method of claim 1 further comprising:

surface incising the rule at two or more incision positions; and folding the rule at the two or more incision positions to form the channel letter having a curve.

4. The method of claim 1 further comprising:

surface incising the rule at one incision position; and folding the rule at the one incision position to form a channel letter having a corner.

5. The method of claim 1, wherein the rule has a rule height measuring 25 to 200 millimeters.

6. The method of claim 1, wherein the rule has a rule thickness between 0.2 to 1.5 millimeters.

7. A method of forming a channel letter using a rule, the method comprising:

determining at least one incision position and a corresponding incision depth on the rule, the rule having first and second surfaces forming a side of the channel letter;

selecting a surface incision angle to enable the rule to be folded by the surface incision angle so that the rule can be folded into a desired channel letter shape;

surface incising by the surface incision angle at the at least one incision position and for the corresponding incision depth using a sawing unit, the sawing unit being configured to make a surface incision into an entire width of the first surface in a direction substantially transverse to a longitudinal axis of the rule, the longitudinal axis of the rule being an axis along which the rule is fed into a rule bending device, wherein surface incising includes determining a number of incisions to make at the at least one incision position to form the desired channel letter shape; and folding the rule at the incision position by the surface incision angle using a folding unit to form the channel letter, the first surface of the rule being on an inside of the channel letter.

8. The method of claim 7 wherein the at least one surface incision removes a portion of the rule at the incision position allowing a fold at the incision position.

9. The method of claim 7 further comprising:

surface incising the rule at two or more incision positions; and folding the rule at the two or more incision positions to form a channel letter having a curve.

10. The method of claim 7 wherein the at least one surface incision has an open edge and a closed edge, the open edge being wider than the closed edge, defining a surface incision angle and giving the at least one surface incision a V-shape.

11. The method of claim 7, wherein the rule has a rule height measuring 25 to 200 millimeters.

12. The method of claim 4, wherein the rule has a rule thickness between 0.2 to 1.5 millimeters.

* * * * *